US006908172B2

(12) United States Patent
Billow et al.

(10) Patent No.: US 6,908,172 B2
(45) Date of Patent: Jun. 21, 2005

(54) METHOD OF SELECTING INKJET NOZZLE BANKS FOR ASSEMBLY INTO AN INKJET PRINTHEAD

(75) Inventors: Steven A. Billow, Rochester, NY (US); James S. Newkirk, LeRoy, NY (US); Douglas W. Couwenhoven, Fiarport, NY (US); Donald J. Hodge, Rochester, NY (US); Kenneth D. Stack, Ann Arbor, MI (US)

(73) Assignee: Eastman Kodak Company, Rochester, NY (US)

( * ) Notice: Subject to any disclaimer, the term of this patent is extended or adjusted under 35 U.S.C. 154(b) by 60 days.

(21) Appl. No.: 10/365,843

(22) Filed: Feb. 13, 2003

(65) Prior Publication Data

US 2004/0160470 A1 Aug. 19, 2004

(51) Int. Cl.[7] ..... B41J 29/393

(52) U.S. Cl. ..... 347/19; 347/40; 347/41; 347/42

(58) Field of Search ..... 347/19, 14, 40, 347/42, 41, 86

(56) References Cited

U.S. PATENT DOCUMENTS 5,975,677 A * 11/1999 Marler et al. ..... 347/40
6,364,451 B1 4/2002 Silverbrook ..... 347/42
6,425,652 B2 7/2002 Otsuki ..... 347/41
6,454,378 B1 9/2002 Silverbrook et al. ..... 347/19
6,464,330 B1 10/2002 Miller et al. ..... 347/40

* cited by examiner

*Primary Examiner*—Hai Pham
*Assistant Examiner*—Lam Nguyen
(74) *Attorney, Agent, or Firm*—Norman Rushefsky; Mark G. Bocchetti

(57) ABSTRACT

A method of selecting inkjet nozzle banks for assembly into an inkjet printhead. The printhead when assembled includes at least two nozzle banks and is operative for printing one particular color ink or other liquid and each nozzle bank includes plural nozzles. The printhead is operational in a printer to print raster rows so that at least one raster row is printed using ink drops deposited at respective different pixel locations on the raster row by respective different nozzles on each of the at least two nozzle banks. The method includes (a) characterizing a drop size parameter for predetermined nozzles of each of the nozzle banks; (b) identifying for each of plural raster rows the respective different nozzles on each of the at least two nozzle banks that would be used to print the respective raster row; (c) identifying a size characteristic associated with each of the plural raster rows using a predetermined computer algorithm without printing the raster rows; and (d) determining in accordance with a criterion and data derived from size characteristic identified in step (c) whether or not the at least two nozzle banks are an acceptable match.

20 Claims, 11 Drawing Sheets

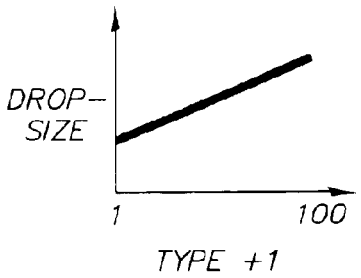
FIG. 12
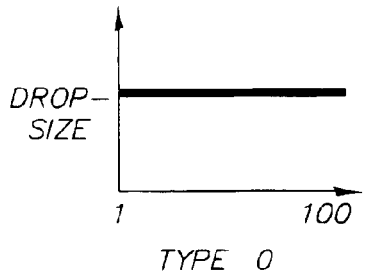
FIG. 13
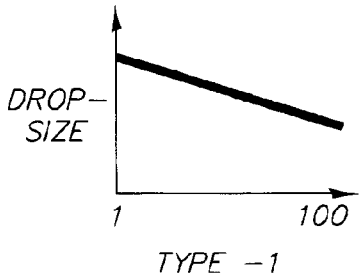
FIG. 14
| COMBINATIONS OF NOZZLE BANK TYPES | | |
|---|---|---|
| -1/-1 | -1/0 | -1/+1 |
| 0/-1 | 0/0 | 0/+1 |
| +1/-1 | +1/0 | +1/+1 |
FIG. 15
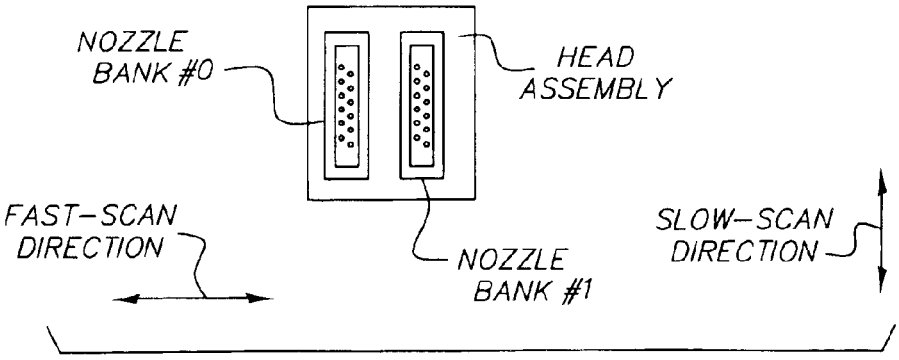
FIG. 16

METHOD OF SELECTING INKJET NOZZLE BANKS FOR ASSEMBLY INTO AN INKJET PRINTHEAD

FIELD OF THE INVENTION

The invention relates generally to the field of printing such as for example inkjet printing and more particularly, in the field of inkjet printing, to a method of selecting inkjet nozzle banks or modules for assembly into an inkjet printhead.

BACKGROUND OF THE INVENTION

Inkjet printing is a non-impact method for producing images by the deposition of ink droplets in a pixel by pixel manner into an image recording element in response to digital signals. There are various methods which may be utilized to control the deposition of ink droplets on the receiver member to yield the desired image. In one process, known as drop-on-demand inkjet printing, individual droplets are ejected as needed on to the recording medium to form the desired image. Common methods of controlling the ejection of ink droplets in drop-on-demand printing include piezoelectric transducers and thermal bubble formation using heated actuators. With regard to heated actuators, a heater placed at a convenient location within the nozzle or at the nozzle opening heats ink in selected nozzles and causes a drop to be ejected to the recording medium in those nozzle selected in accordance with image data. With respect to piezo electric actuators, piezoelectric material is used in conjunction with each nozzle and this material possesses the property such that an electrical field when applied thereto induces mechanical stresses therein causing a drop to be selectively ejected from the nozzle selected for actuation. The image data provided as signals to the printhead determines which of the nozzles are to be selected for ejection of a respective drop from each nozzle at a particular pixel location on a receiver sheet. Some drop-on-demand inkjet printers described in the patent literature use both piezoelectric actuators and heated actuators.

In another process, known as continuous inkjet printing, a continuous stream of droplets is discharged from each nozzle and deflected in an imagewise controlled manner onto respective pixel locations on the surface of the recording member, while some droplets are selectively caught and prevented from reaching the recording member. Inkjet printers have found broad applications across markets ranging from the desktop document and pictorial imaging to short run printing and industrial labeling.

A typical inkjet printer reproduces an image by ejecting small drops of ink from the printhead containing an array of spaced apart nozzles, and the ink drops land on a receiver medium (typically paper, coated paper, etc.) at selected pixel locations to form round ink dots. Normally, the drops are deposited with their respective dot centers on a rectilinear grid, i.e., a raster, with equal spacing in the horizontal and vertical directions. The inkjet printers may have the capability to either produce only dots of the same size or of variable size. Inkjet printers with the latter capability are referred to as (multitone) or gray scale inkjet printers because they can produce multiple density tones at each selected pixel location on the page.

Inkjet printers may also be distinguished as being either pagewidth printers or swath printers. Examples of pagewidth printers are described in U.S. Pat. Nos. 6,364,451 B1 and 6,454,378 B1. As noted in these patents, the term "pagewidth printhead" refers to a printhead having a printing zone that prints one line at a time on a page, the line being parallel either to a longer edge or a shorter edge of the page. The line is printed as a whole as the page moves past the printhead and the printhead is stationary, i.e. it does not raster or traverse the page. These printheads are characterized by having a very large number of nozzles. The referenced U.S. patents disclose that should any of the nozzles of one printhead be defective the printer may include a second printhead that is provided so that selected nozzles of the second printhead substitute for defective nozzles of the primary printhead.

Today the fabrication of pagewidth inkjet printheads is relatively complex and they have not gained a broad following. In addition there are problems associated with high-resolution printing in that simultaneous placement of ink drops adjacent to each other can create coalescence of the drops resulting in an image of relatively poor quality.

Swath printers on the other hand are quite popular and relatively inexpensive as they involve significantly fewer numbers of nozzles on the printhead. In addition in using swath printing and multiple passes to print an area during each pass, dot placement may be made selectively so that adjacent drops are not deposited simultaneously or substantially simultaneously on the receiver member. There are many techniques present in the prior art that described methods of increasing the time delay between printing adjacent dots using methods referred to as "interlacing", "print masking", or "multipass printing." There are also techniques present in the prior art for reducing one-dimensional periodic artifacts or "bandings." This is achieved by advancing the paper by an increment less than the printhead width, so that successive passes or swaths of the printhead overlap. The techniques of print masking and swath overlapping are typically combined. The term "print masking" generally means printing subsets of the image pixels in multiple passes of the printhead relative to a receiver medium. In swath printing a printhead, having a plurality of nozzles arranged in a row, is traversed across a page to be printed. The traversal is such as to be perpendicular to the direction of arrangement of the row of nozzles.

With reference to commonly assigned U.S. Pat. No. 6,464,330 B1 filed in the names of Miller et al., an example of a printhead used in a swath printer is illustrated. The disclosure in this patent is incorporated herein by reference thereto. With reference to FIG. 1, printhead 31 for each color of ink to be printed includes in this embodiment two printhead segments or modules or nozzle banks 39A and 39B. Each printhead nozzle bank includes two staggered rows of nozzles and the nozzles in each row of nozzles have a spacing of 1/150 inches between adjacent nozzles in the row. However, due to the presence of staggering there is a nominal nozzle pitch spacing, P, in each printhead nozzle bank of 1/300 inches as indicated in the figure. The nozzles on the second nozzle bank 39B are similar to that on the first nozzle bank 39A and the nozzle banks are arranged to continue the nozzle spacing for the printhead of 1/300 inches spacing between nozzles. The printhead nozzle banks may each also be referred to as a "nozzle module" because they are individually assembled into a supporting structure to form the printhead for printing a particular color. Each nozzle bank may also be referred to as a pen, segment or a module. Hereinafter, they will be referred to as a nozzle bank. It will be understood that for a printer having six different color inks, six printheads similar to that described for printhead 31 may be provided. The six different color printheads are arranged on a carriage that is traversed across the receiver sheet for a print pass. The nozzles in each of the six color printheads, are actuated to print with ink in their respective colors in accordance with image instructions received from a controller or image processor. Each printhead, would in the example of the subject printer, have two printhead nozzle banks.

The printhead nozzle banks used in inkjet printers can suffer from variations in the manufacturing process that cause the drop size ejected by one nozzle in a nozzle bank to be different from the drop size ejected by another nozzle of that nozzle bank. If this variation in drop size is sufficiently large and of a certain distribution unacceptable banding in printed images can result.

Consider a first hypothetical example in which, because of a manufacturing related processing artifact, there is a drop size variation from one end of a 100-nozzle 1 inch printhead nozzle bank to the other end and the drop size varies linearly between the two extremes. The exemplary printhead nozzle bank is illustrated in FIG. 2. In FIG. 3 there is illustrated a graph showing the drop size variation from nozzle No. 1 to nozzle No. 100. If this printhead nozzle bank was the only one used in printing and used in a 1-pass mode a flat field 2 inch by 2 inch image would appear as illustrated in FIG. 4. The printed result shown in FIG. 4 features for the first vertical inch of the image a gradually increasing density distribution. For the second vertical inch of the image this is repeated, thereby providing an abrupt change in density between the end of the first vertical inch and the beginning of the second vertical inch. In FIG. 5 there is illustrated a graph showing the relationship between the optical density and raster row of print and illustrating quite clearly the abrupt change or discontinuity in density between the 100th row and the 101st row of the image. This abrupt change in density will be noted as an unacceptable banding in a typical image at every one hundred lines of print. Increasing the number of passes decreases the amplitude of this banding and doubles the frequency at the price of lower productivity. Consider the response if we print in a two-pass mode the graphical representation of density of which is illustrated in FIG. 6.

In a printer system with two printhead nozzle banks that are assembled to form a single printhead, as illustrated in FIG. 1, for printing a single color the same problem can arise if no consideration is given as to how printhead nozzle banks are combined.

SUMMARY OF THE INVENTION

In accordance with an object of the invention, a method is provided for reducing image artifacts in printers that employ two or more printhead nozzle banks that are assembled to form a single printhead and used to print single color of ink.

In accordance with a first aspect of the invention, there is provided a method of selecting inkjet nozzle banks for assembly into an inkjet printhead, the printhead when assembled including at least two nozzle banks and operative for printing one particular color ink or other liquid and each nozzle bank including plural nozzles, the printhead being operational in a printer to print raster rows so that at least one raster row is printed using ink drops deposited at respective different pixel locations on the raster row by respective different nozzles on each of the at least two nozzle banks, the method comprising the steps of (a) characterizing a drop size parameter for predetermined nozzles of each of the nozzle banks; (b) identifying for each of plural raster rows the respective different nozzles on each of the at least two nozzle banks that would be used to print the respective raster row; (c) identifying a size characteristic associated with each of the plural raster rows using a predetermined computer algorithm without printing the raster rows; and (d) determining in accordance with a criterion and data derived from size characteristic identified in step (c) whether or not the at least two nozzle banks are an acceptable match.

In accordance with a second aspect of the invention, there is provided a method of selecting inkjet nozzle banks for assembly into an inkjet printhead, the printhead when assembled including at least two nozzle banks and operative for printing one particular color ink or other liquid and each nozzle bank including plural nozzles, the method comprising the steps of (a) determining a drop size parameter(s) for the nozzles of each nozzle bank by examining printed lines or dots made by the respective nozzles of the respective nozzle bank; and (b) after step (a), determining using a computer algorithm and without assembly of the nozzle banks into a printhead as to whether or not the at least two nozzle banks are an acceptable match.

In accordance with a third aspect of the invention, there is provided a method of selecting recording element banks for assembly into a printhead, the printhead when assembled including at least two recording element banks and the banks being operative for printing raster rows wherein each bank includes plural recording elements and for at least some of the raster rows a recording element from each of the at least two recording element banks is used in printing pixels in the same raster row, the method comprising the steps of (a) determining a size parameter for the recording elements of each recording element bank by examining printed lines or dots or emissions made by the respective recording elements of the respective recording element bank; and (b) after step (a), determining using a computer algorithm and without assembly of the recording element banks into a printhead as to whether or not the at least two recording element banks are an acceptable match.

While the specification concludes with claims particularly pointing out and distinctly claiming the subject matter of the present invention, it is believed the invention will be better understood from the following detailed description when taken in conjunction with the accompanying drawings wherein:

BRIEF DESCRIPTION OF THE DRAWINGS

FIG. 12–14 are graphs illustrating different exemplary nozzle bank drop size ejecting characteristics types.

FIG. 15 is a chart illustrating different combinations of possible nozzle types to form a printhead from nozzle types having the characteristics of FIGS. 12–14.

FIG. 16 is a schematic of an alternative assembly positioning of nozzle banks in a printhead for which the invention may be used and wherein the nozzle banks are spaced in the fast scan direction but not spaced in the slow scan direction.

DETAILED DESCRIPTION OF THE INVENTION

Figure 1:
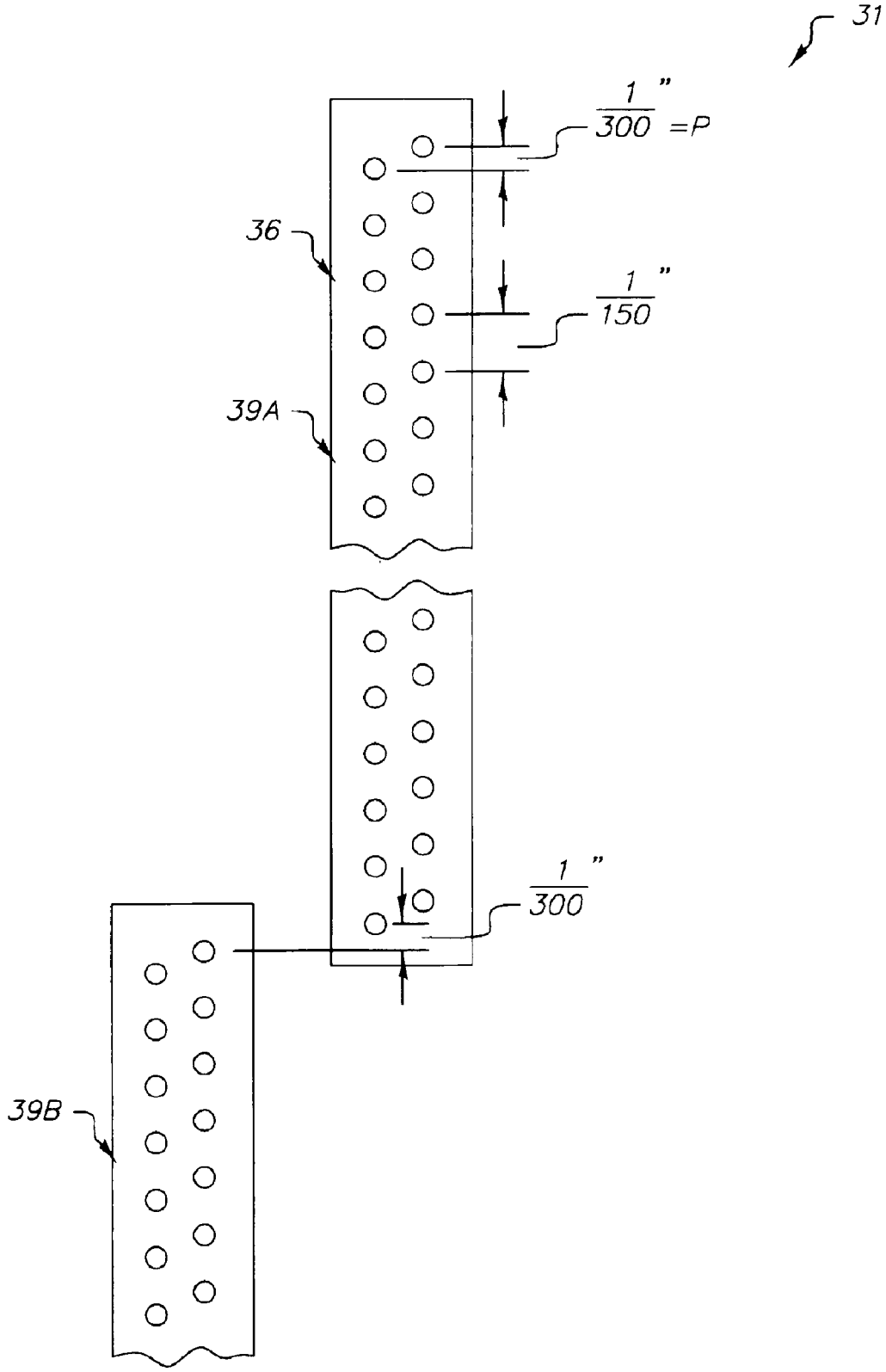
FIG. 1 (PRIOR ART)
FIG. 1 illustrates a prior art printhead featuring two printhead nozzle banks.
Figure 2:
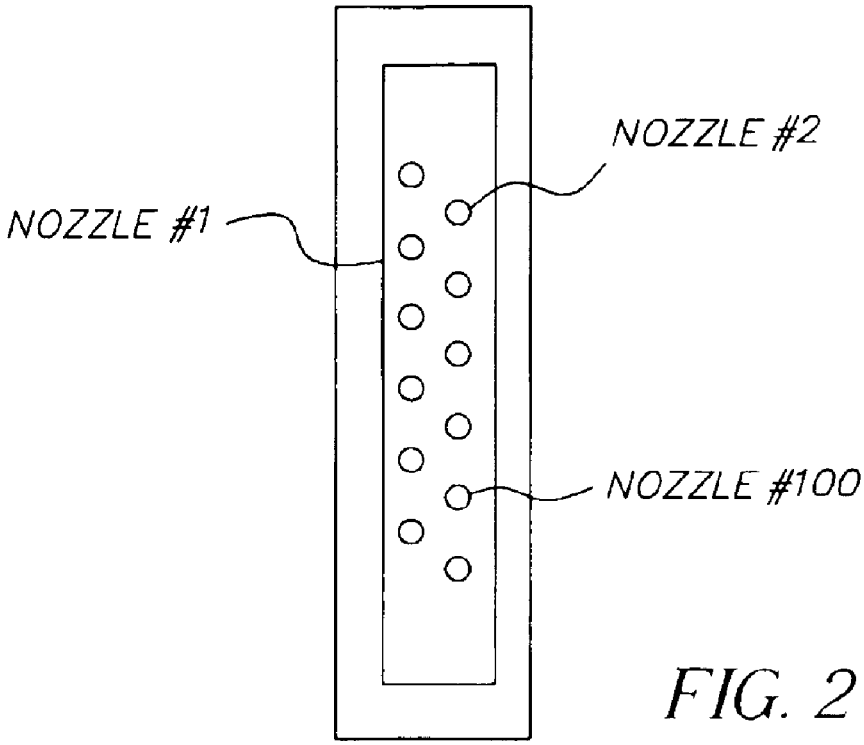
FIG. 2 illustrates an exemplary printhead nozzle bank of the prior art.
Figure 3:
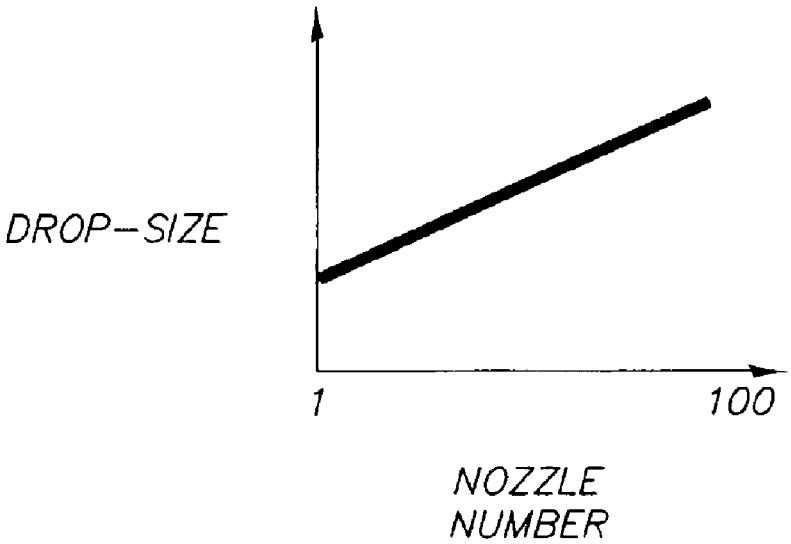
FIG. 3 is a graph showing hypothetical drop size variation from nozzle No. 1 to nozzle No. 100 using the printhead nozzle bank of FIG. 2 the variation being due to an artifact such as in manufacturer of the nozzle bank.
Figure 4:
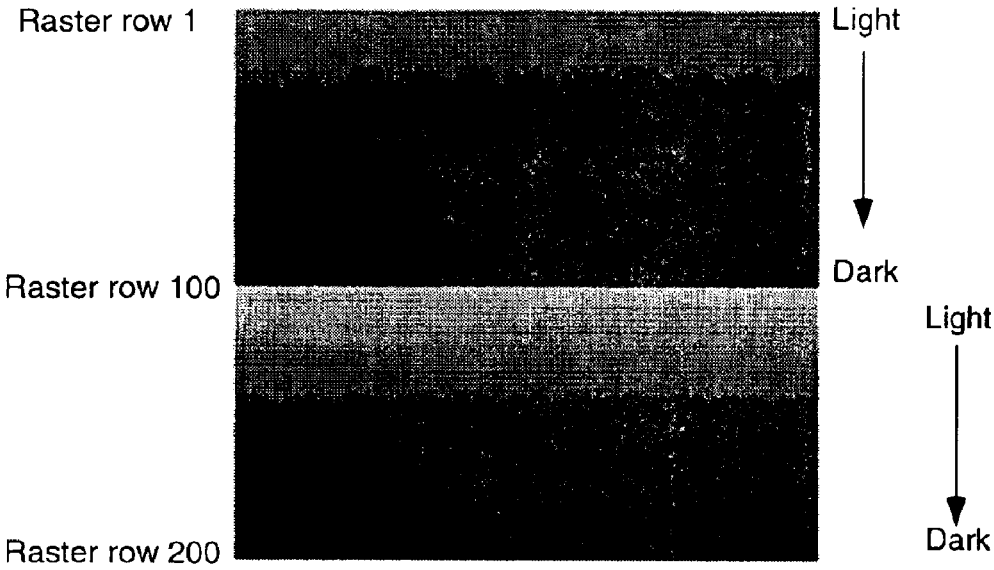
FIG. 4 illustrates a flat field 2 inch by 2 inch image printed by the printhead nozzle bank of FIG. 2.
Figure 5:
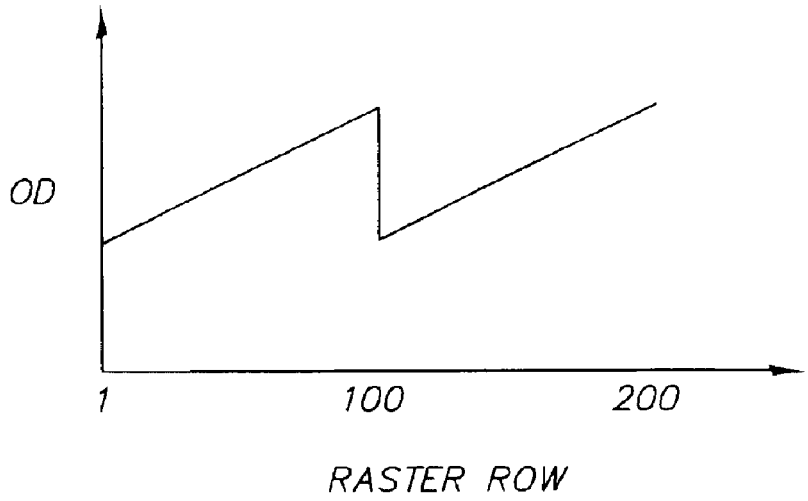
FIG. 5 is a graph showing the relationship between optical density and raster row of a print having the printed image of FIG. 4.
Figure 6:
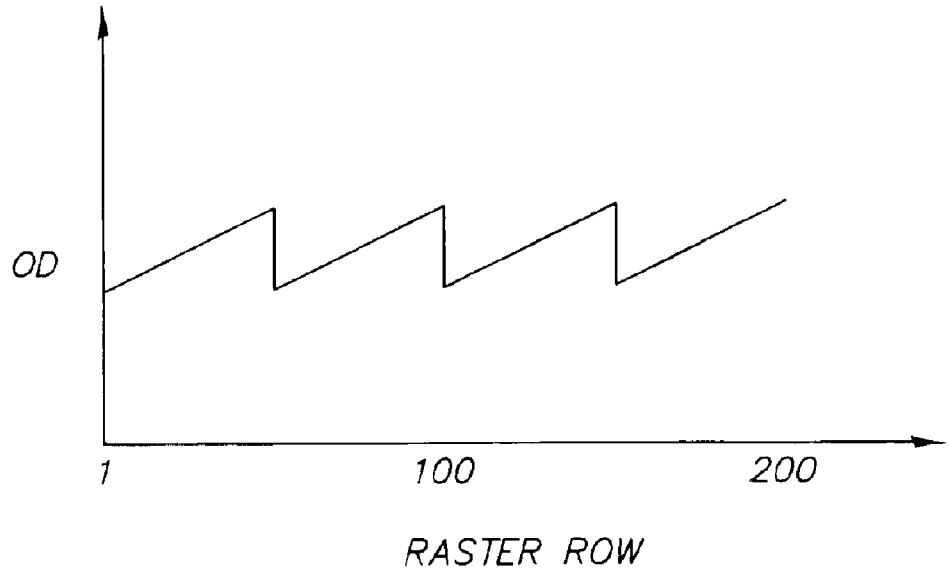
FIG. 6 is a graph showing the relationship between optical density and raster row of a print having a printed image printed in a two-pass mode using the printhead nozzle bank of FIG. 2.

The present description will be directed in particular to elements forming part of, or cooperating more directly with, apparatus and methods in accordance with the present invention. It is to be understood that elements not specifically shown or described may take various forms well known to those skilled in the art.

In the specification, various terms are employed and are defined as follows:

The term "banding" refers to an imaging artifact in which objectionable lines or density variations are visible up and in the image. Banding may occur as vertical banding or horizontal banding, the horizontal direction coinciding with the fast scan direction and the vertical direction coinciding with the slow scan direction.

The term "dot size" relates to the size of a printed dot and may be determined by thresholding a digitized target containing the dots, the dot size may be expressed as an area, diameter, or other convenient metric. Dot size may be inferred from optical density of the centers of printed dots.

The term "drop size" may be expressed in units of volume or diameter and relates to the size of the drop ejected by a nozzle. Drop size may also be inferred by determining the speed of the drop, larger drops having greater speed. "Dot size variation" results from the differences in drop sizes ejected by different nozzles of an ink jet printer when printing a flat field image.

The term "flat field image" refers to an image in which the code value is relatively constant. In the examples provided herein, the flat field image means that a drop is requested at every pixel location in a relatively small area sufficient to provide enough data for the purposes described herein. It will be understood of course that in performing the method of the invention there is consideration of hypothetical printing of flat field images which are done as computer simulation and not as actual printings.

The term human contrast sensitivity function refers to a description of the acutance of the human vision system as a function of cycle/degree and may be inferred from various known functions that have been determined to meet the criteria or by an approximation thereof for example such as a Gaussian distribution.

The term "raster row" refers to a horizontal swath of an image of height equal to 1/DPI.

The term "DPI" means dots-per-inch. In the case of symmetric printing, the DPI is the same in both the fast scan and slow-scan directions. For asymmetric printing, DPI refers to the resolution in the slow scan direction.

The term "fast scan direction" refers to the direction in which the printhead is transported during a print pass.

The term "slow scan direction" refers to the direction in which the receiver medium is advanced in between print passes. Typically, the fast scan direction and the slow scan direction are orthogonal.

Multiple print passes over a swath may be used for reasons of requiring isolation of ink drops both spatially and temporally by employing a print mask which specifies in which locations a drop is ejected from the printhead on each swath. In addition multiple print passes may be provided for increasing the resolution of the print to provide smaller desired dot pitches. For example, a printhead having a nominal 1/300 inches pitch resolution may be used to print at 600 DPI by providing two resolution passes over the swath area or for printing at 1200 DPI by providing four resolution passes over the swath area.

Figure 7:
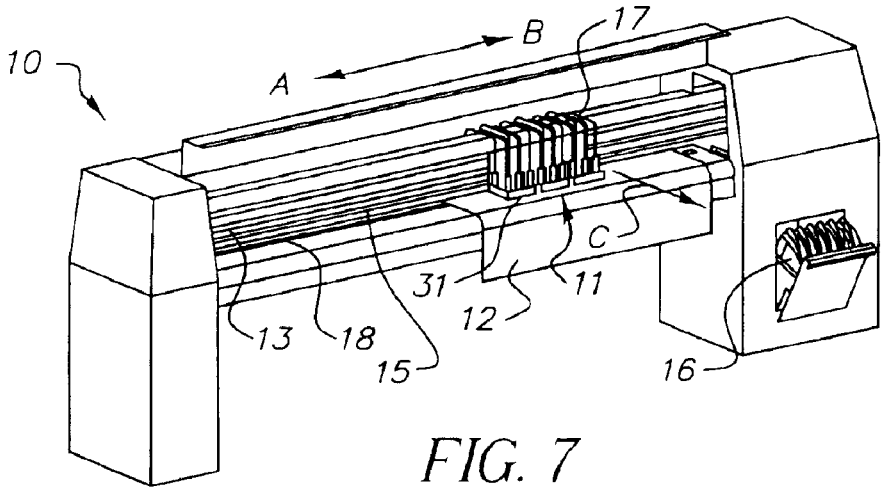
FIG. 7 is a printer which incorporates assembled printhead nozzle banks to form printheads in accordance with the method described herein.

With reference to FIG. 7, there shown a printer 10 which incorporates assembled printhead nozzle banks in accordance with the methods described above. Reference 11 designates a carriage. An inkjet printhead 31 faces the recording medium and includes nozzle banks 39A and 39B mounted on a printhead modular structure 25 (FIG. 8) which in turn is mounted on the carriage 11. Carriage 11 is coupled through a timing belt 13 with a driver motor (not shown) so as to be reproducibly movable relative to the recording medium 12 (in the directions of the arrows A–B) while being guided by a guide member 15. The inkjet printhead 31 receives ink from a respective ink color bulk supply tank 16 through ink supply tube 17. As is known, a separate smaller supply of ink may be associated with a smaller reservoir closer to the printhead so that the printhead receives ink from the smaller reservoir which in turn is replenished by the supply tank 16. A different supply of ink is provided to each printhead 31. A transport roller 18, when driven by the drive motor (not shown), transports the recording medium 12 in the direction (arrow C) perpendicular to the moving direction of the carriage 11.

Figure 8:
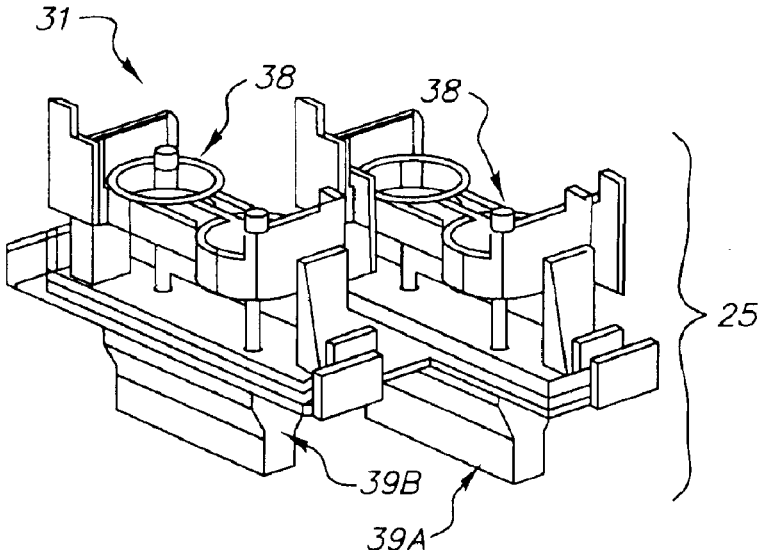
FIG. 8 illustrates a printhead assembly module featuring two nozzle banks for use in the printer of FIG. 7.
Figure 9:
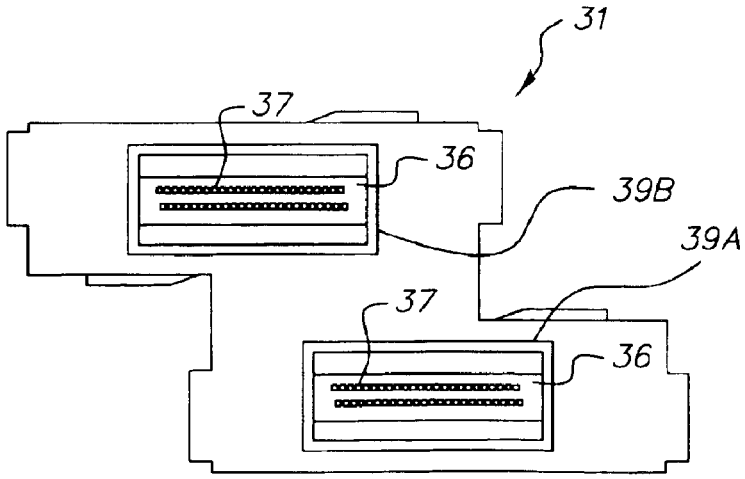
FIG. 9 illustrates the printhead assembly module of FIG. 8 and viewed from the prospective of a receiver medium.

FIGS. 8 and 9 show an embodiment of a piezoelectric printhead assembly module 25 that features the two assembled nozzle banks 39A and 39B. Reference No. 36 designates a nozzle plate, associated with each nozzle bank, and having nozzle openings 37 formed therein. A supply port 38 is provided on assembly module 25 through which ink flows from the ink tank 16 (or from a separate reservoir as noted above) via an ink supply tube 17. Although illustration is provided of a piezoelectric printhead the invention may be carried out with other printheads such as thermal and continuous inkjet printheads.

Six different color printheads are arranged on the carriage 11 and as the carriage is traversed across the receiver sheet 12 for a print pass the nozzles in each of the six color printheads are actuated to print with ink in their respective colors in accordance with the image instructions received from the controller or image processor such as a RIP (raster image processor) and as such instructions are modified in accordance with the teachings described in U.S. Pat. No. 6,464,330 as a preferred example. Typically in printers of this type the number of nozzles provided is insufficient to print an entire image during a print pass and thus plural print passes are required to print an image with the receiver sheet being indexed in the direction of the arrow C after each pass. Where print masking is used typically indexing of the receiver sheet in the slow scan direction is done for an amount less than the length of the nozzle bank until the image that is to be printed in this swath is printed through multiple passes of the printhead.

Thus, the inkjet printer configurations employed herein comprise one or more inkjet printheads each of which have two or more banks of nozzles. Each nozzle can eject drops independently. An inkjet printhead drive mechanism moves the printhead in a direction transverse or generally perpendicular to the array of nozzles. This direction is referred to as the fast scan direction. Mechanisms for moving the printhead in this direction are well known and usually, comprise providing the support of the printhead or carriage on rails, which may include a rail that has a screw thread, and advancing the printhead along the rails such as by rotating the rail with the screw thread or otherwise advancing the printhead along the rails such as by using a timing belt and carriage. Such mechanisms typically provide a back and forth movement to the printhead. Signals to the printhead, including data and control signals, can be delivered through a flexible band of wires or an electro-optical link. As the printhead is transported in the fast scan direction, the nozzles selectively eject drops at intervals in accordance with enabling signals from the controller that is responsive to image data input into the printer. The intervals in combination with the nozzles spacing represent an addressable rectilinear grid, or raster, on which drops are placed. A pass of the printhead during which drops are rejected is known as a print pass. The drops ejected during a print pass land on an inkjet receiver medium. After one or more print passes, the print media drive moves the inkjet print receiver medium; i.e. the receiver sheet such as paper, coated paper or plastic or a plate from which prints can be made (lithographic plate), past the printhead in a slow scan direction which is perpendicular to or transverse to the fast scan direction. After the print medium or receiver media member has been advanced, the printhead executes another set of one or more print passes. Printing during the next pass may be while the printhead is moving in the reverse direction to that moved during the prior pass. The receiver member may be a discrete sheet driven by a roller or other known driving device or the receiver sheet may be a continuous sheet driven, typically intermittently, by a drive to a take-up roller or to a feed roller drive.

Figure 10:
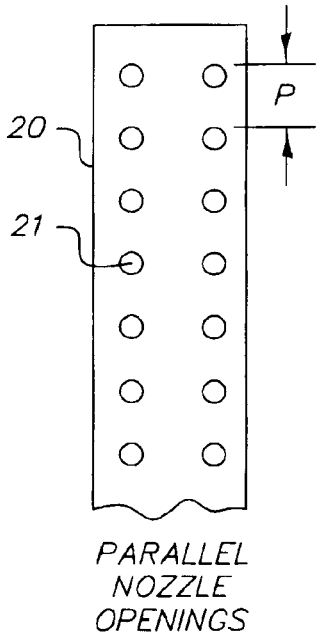
FIG. 10 illustrates an alternative nozzle bank configuration with which the invention may be used.

Printheads to which this invention is directed may also comprise nozzle banks 20 shown in FIG. 10 wherein one or two parallel rows of nozzles 21 that are not staggered thus allowing printing of at least certain pixels using drops output by two nozzles in succession at the same pixel location.

Figure 11:
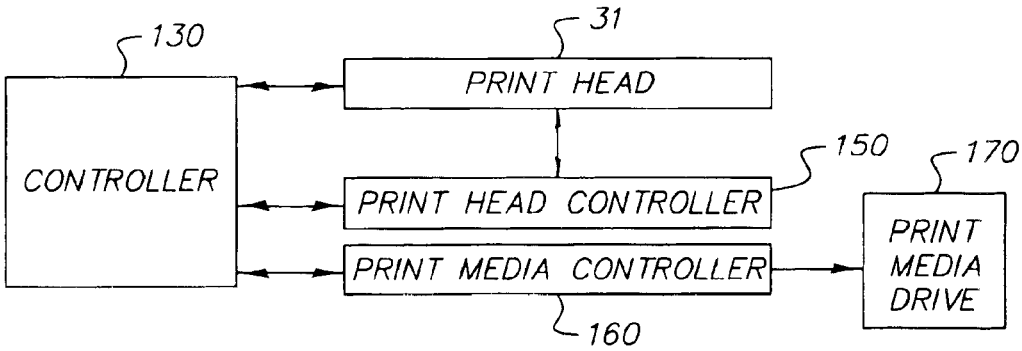
FIG. 11 is a block diagram of a printer control system.

Referring now to FIG. 11, an inkjet printer is schematically shown in which a controller 130 controls a printhead 31, a printhead controller and driver 150 and a print media controller and driver 160. The controller 130, which may include one more micro-computers is suitably programmed to provide signals to the printhead controller and driver 150 that directs the printhead drive to move the printhead in the fast scan direction. While the printhead is moving in the fast scan direction, the controller directs the printhead to eject ink drops onto the receiver medium at appropriate pixel locations of a raster when pixels on the raster are being selectively printed in accordance with image signals representing print or no print decisions in each pixel location and/or pixel density gradient or drop size at each pixel location. The controller 130 may include a raster image processor which controls image manipulation of an image file which may be delivered to the printer via a remotely located computer through a communication port. On board memory stores the image file while the printer is in operation. Thus as noted above the printer may include a number of printheads for printing a respective number of color inks, and preferably the printer includes enough printheads to print three or more different color inks.

In accordance with the invention, reduction in banding can occur as taught herein through proper selection of printhead nozzle banks for use in each printhead that employs two or more different printhead nozzle banks to increase printer productivity.

A basic concept of the invention may be best understood from the example illustrated with reference to FIGS. 12–14 wherein the drop size variation is characterized by a linear trend depending upon the slope and magnitude of variation. Assume that a printhead is to be formed so as to include two printhead nozzle banks as illustrated in FIG. 1. Further assume that the universe of selectable printhead banks that may be chosen to form the printhead have the characteristics of either FIG. 12, FIG. 13 or FIG. 14. In the case of combining two printhead nozzle banks from this universe there are nine possible combinations. It is also assumed that the receiver medium when it advances is moved uniformly for each advancement and that the print mode uses at least two passes. With such a printer there are only three of the nine possible combinations that will produce acceptable results. These are illustrated in the chart of FIG. 15 wherein the shaded area identifies those combinations of two printhead nozzle banks that may be selected as a combination for use in a printhead having two printhead nozzle banks and which would produce acceptable results (diminished banding). As the number of different types of printhead nozzle bank characteristics increases (amplitude of variation or non-linear variation, for example), the number of acceptable combinations decreases further. This can cause significant losses in yield if no consideration is given as to how printhead nozzle banks are combined to form a printhead. In the example of combining the nozzle bank of FIG. 12 (referred to as Type+1) and the nozzle bank of FIG. 14 (referred to as Type−1) the combination could be assembled such as in the configuration of FIG. 9 with either one being nozzle bank 39A and the other being nozzle bank 39B since in either case there would not be an abrupt discontinuity in density between adjacent lines of printing where printing is made in at least two passes. If the Type+1 and Type−1 nozzle banks are combined in a printhead having the configuration of FIG. 16 benefits can be derived even with only single pass printing. Of course, the assumption herein is that each nozzle bank can be mounted in only one direction and not turned around which would present a different operating characteristic from that illustrated in the FIGS. 12 and 14.

Consider the case in which the drop-size variation for each nozzle bank was known before assembling into a printhead. By ensuring that Type+1 nozzle banks are always paired with Type−1 nozzle banks performance will be acceptable. Similarly, Type 0 nozzle banks are to be always paired with a Type 0 nozzle bank, ensuring adequate quality once again. The requirements for employing this technique require that the drop size (or similarly, dot size) be characterized for each nozzle bank before assembly into a printhead. Additionally, a sufficient storage of separate nozzle banks needs to be maintained such that a matching pair can be found (e.g., if you have a Type+1 in storage, you have to wait to find a Type−1 to form the printhead).

As a modification of this method, printheads may be characterized as Type +1. . . Type+n while others are considered Type 0 and Type−1. . . Type−n to increase the number of discrete assigned types for possible matching and thus to provide for more control over likelihood of banding as matching of similar Types of nozzle banks when using a relatively large number of discrete assigned types (that is Type+n would be matched with Type−n, and Type 0 matched with a Type 0 as before) is more likely to result in adjacent pixel rows being printed within an acceptable predetermined threshold. The threshold that may be used may be a function of the desired quality level.

As the number of "Types" of drop-size variation nozzle banks increases (e.g., various amplitudes and/or non-linear variations), the matching can become increasingly complex and the table shown in FIG. 15 can become quite large and perhaps oppressively large. In addition, nozzle banks having the printhead configuration illustrated in FIG. 1 cause acceptable matches to be a function of the nature of receiver medium advancement, which may be nonuniform, further complicating the matching process. In these situations, it is most useful to roughly simulate the printing process to identify the nozzles that are expected to print on any raster row of a flat-field image. By identifying these nozzles, the average drop size on any raster row can be calculated. Once you have this information, coupled with the drop-size variation characterization of each nozzle bank and acceptable product threshold for banding, acceptable assemblies forming a printhead may be created in numerous ways. One preferred such method is described below. Although reference has been made to an assembly of nozzle banks forming a printhead having the configuration shown in FIG. 1 the invention also contemplates that the assembly of nozzle banks may be made in accordance with configuration shown in FIG. 16.

Figure 17:
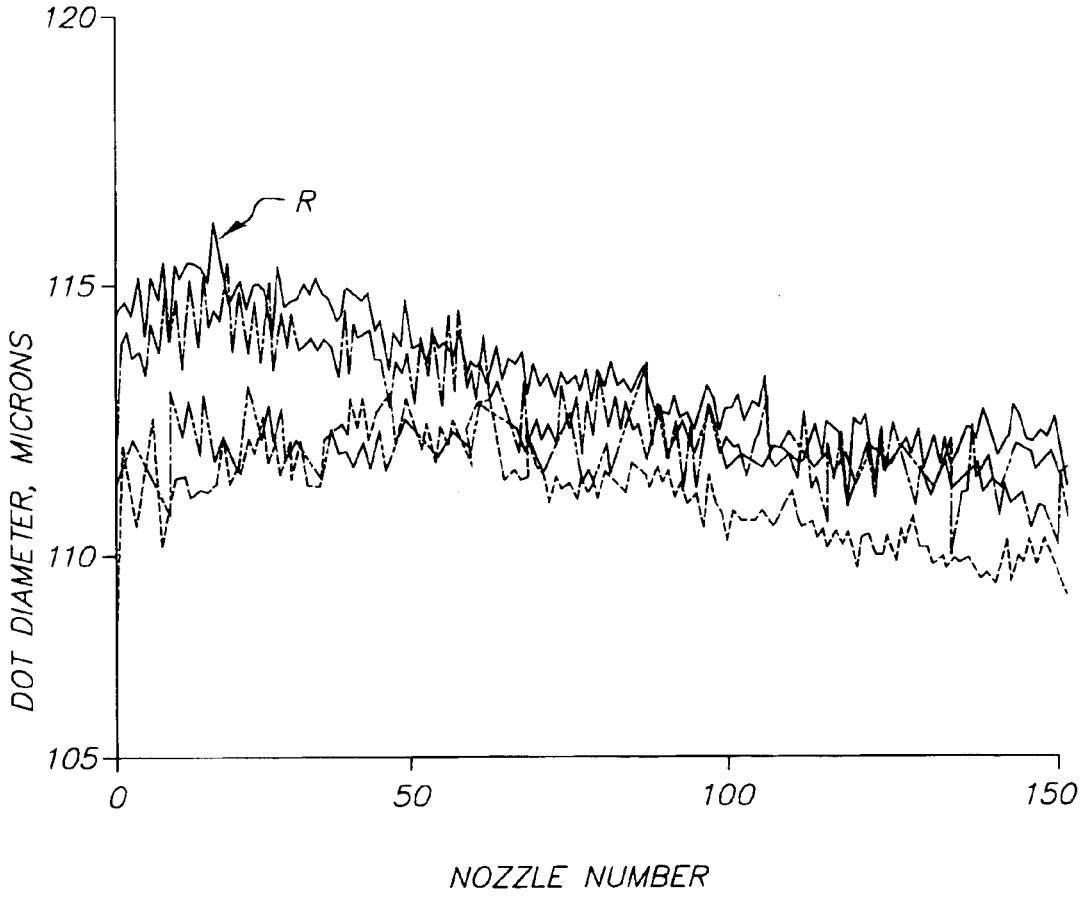
FIG. 17 is a graph illustrating dot size variation as a function of nozzle for an exemplary printhead having a configuration such as that in FIG. 1 with two nozzle banks and four rows of nozzles.

In a preferred selection method initially each nozzle bank is characterized for drop-size variation (or similarly, dot-size variation) as a function of nozzle. Four such characterizations are shown in the graph of FIG. 17. FIG. 17 may best be understood by referring to FIG. 1 wherein nozzle bank 39A has two rows of nozzles and nozzle bank 39B also has two rows of nozzles, each of the four rows have 150 nozzles arranged in a straight line. The four plots shown in FIG. 17 thus refer to the four rows in the printhead having the two nozzle banks 39A and 39B. The row of nozzles identified as R has a dot diameter of about 115 microns near nozzle No. 1 but about 112 microns near nozzle No. 150. These small variations can cause unacceptable banding if not accounted for.

A test simulation is then run to simulate various combinations of the nozzle banks to see if they will produce acceptable results. For example, assume that the printhead one is trying to create requires only two nozzle banks in a geometry similar to that shown in FIG. 1 wherein each of two nozzle banks contains two nozzle rows. Also assume in this case, the two nozzle rows within a nozzle bank cannot be interchanged-only nozzle banks may be changed so as to be combined with a different nozzle bank.

Figure 18:
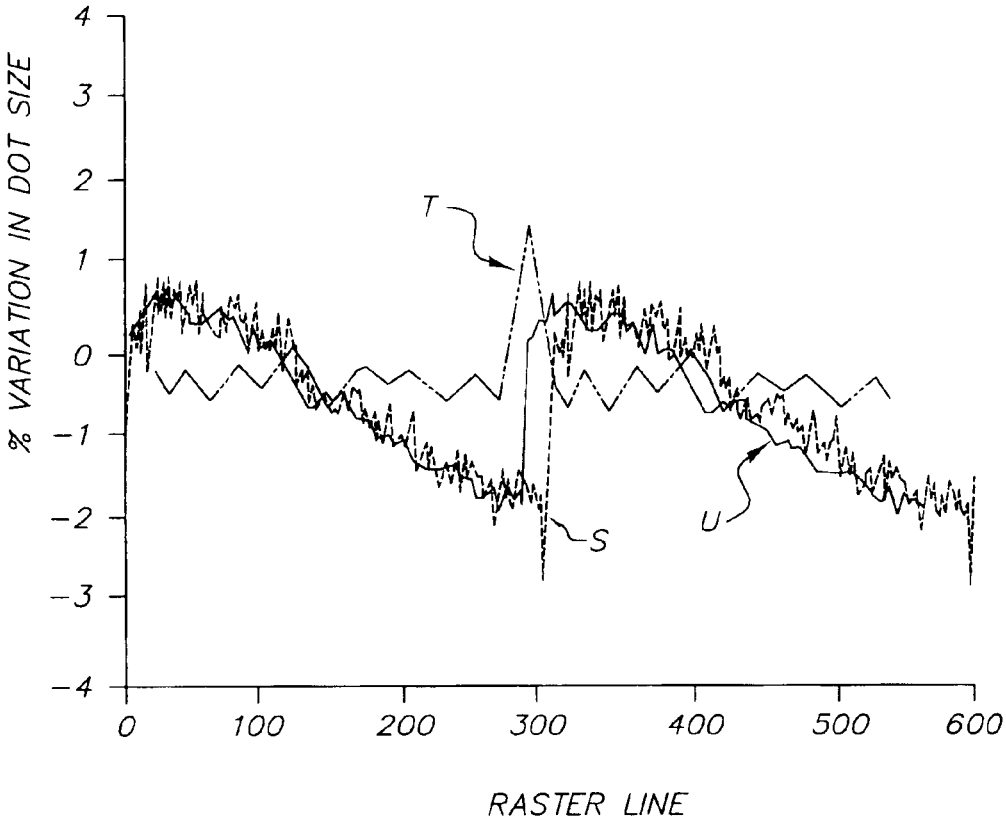
FIG. 18 is a graph illustrating dot size variation as a function of printed line number for the exemplary printhead having the characteristics indicated by FIG. 17.

Furthermore, assume that the print mode is one in which the resolution of printing is equal to the nozzle pitch on a printhead (the example of FIG. 1 shows a nozzle pitch and hence assumed printing resolution of 1/300 as an example) and uses two banding passes and a receiver medium advance after each of the two banding passes that is approximately uniform. However, this technique is readily applicable to other print modes with higher resolution printing, different number of banding passes, or various receiver medium advancement schemes following the banding passes. This information is used to determine what nozzle will print a given raster row and the average dot size used to print a raster row can be plotted as a function of raster row is demonstrated by the line S in FIG. 18 using the two nozzle banks 39A and 39B and having characteristics described by the characteristics shown in FIG. 17. The line U in FIG. 18 is a low-pass filtered version of the first swath of the line S (the first 300 raster rows). The second half of the line U is a duplicate of the first half. A low-pass filter is used in this case to reduce our sensitivity to noise of high frequency to which, at a normal expected viewing distance of an image, a person would probably be insensitive to. The bandpass of the low pass filter may be determined upon the human contrast sensitivity function and expected viewing distance. The phase delay due to the filter has not been taken into account but is considered of no consequence for purposes of this discussion.

The next step is to decide whether or not this printer will be acceptable for banding quality. As noted in the discussion above, the most objectionable banding comes from large steps of low frequency in average dot size as a function of raster row. The large step in each of the lines S and U near the raster row of 300 indicates that banding may be a problem for this printer. By examining the magnitudes of these discontinuities, one can determine, based upon product specifications, whether or not a printhead will produce acceptable results. The third line T FIG. 18 is one simple way to estimate the magnitude of the discontinuity. By taking the magnitude of the difference between two moving averages, offset by an amount equal to their width, an approximation to the first derivative of the line U can be made. If the magnitude of this difference is large, that means there is a large discontinuity somewhere. By looking at the maximum of the line T, an estimate as to expected head assembly performance can be made in accordance with comparison with an establish maximum threshold value and the decision as to whether or not to assemble these modules is facilitated.

Figure 19:
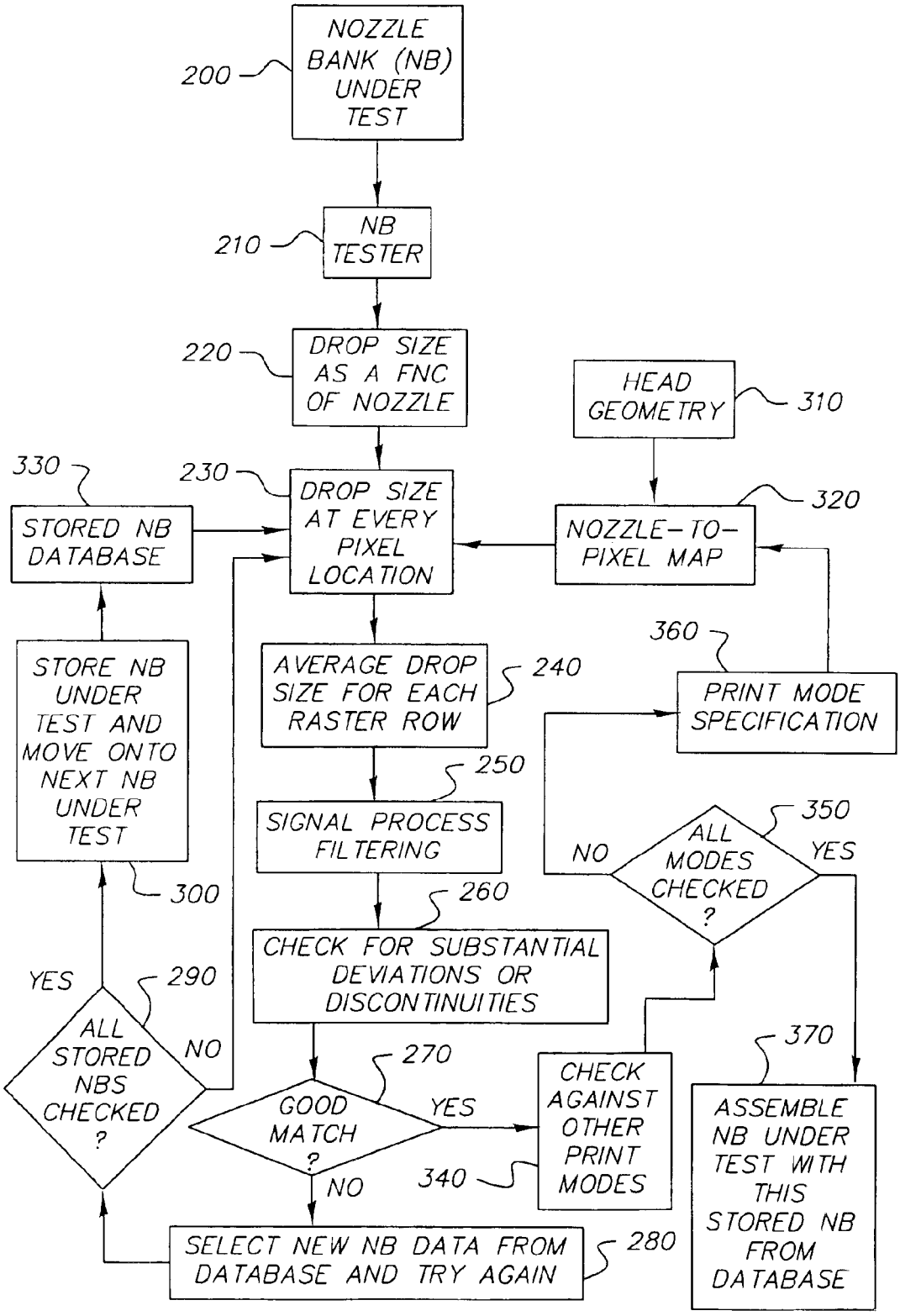
FIG. 19 is a flowchart illustrating steps in a preferred method of determining selection of nozzle banks for a printhead in accordance with the invention.

With reference now to the flowchart illustrated in FIG. 19, an algorithm for determining selection of appropriate pairs of nozzle banks for assembly into a printhead is provided.

In step 200, a nozzle bank previously untested is selected for possible matching with a previously tested nozzle bank.

In step 210, the nozzle bank is tested by using this nozzle bank to print a series of pixels from each of the say 300 nozzles that comprise this nozzle bank.

For example 50–70 pixels may be printed from each nozzle. The printed pixels are then scanned by a scanner and an average taken to determine an average dot size printed by the nozzle. Note that in this test drop size is characterized by printed dot size and averages taken therefrom, however it will be appreciated that drop size may be characterized by or inferred from measurement of the drop itself before reaching a receiver medium or immediately upon depositing on the receiver medium before spreading. As an alternative in determining average dot size printed by a nozzle, an average line width of a row of printed dots printed by a nozzle may be used as a measurement of average dot size or dot size inferred therefrom.

In step 220, the results of the step 210 are then stored in a memory associated with a computer that is controlling the test procedure and operating under an algorithm to perform the steps described below. Thus, there is established and stored in a memory controlled by the computer an average drop size as a function of each nozzle for the nozzle bank under test.

In step 230, the nozzle bank under test is considered to have a possible pairing with a second nozzle bank having a known drop size as a function of nozzle characteristic. Data regarding average drop size as a function of nozzle for the second nozzle bank is recalled as needed from a memory which comprises a stored head database, see step 330. From step 310 the head geometry is identified; e.g. see geometry shown in FIG. 1 with the nozzle bank under test being identified as located similar to that of nozzle bank 39A and the possible pairing nozzle bank being positioned at the location of nozzle bank 39B. Furthermore, from step 360 there is obtained for this test a print mode specification establishing a hypothetical pass mode operation that is under consideration so that there can be established a table or pixel mapping in step 320 determining which nozzles would be expected to print which pixels in a raster row. It will be understood that in typical operation of a printhead, where multipass printing is done to reduce coalescence and having two nozzle banks, that most raster rows will comprise a raster row of pixels some of which pixels have been printed by a nozzle from one nozzle bank and other pixels printed by a different nozzle which nozzle may be located on another nozzle bank. Further in step 230 the computer, using the nozzle determined pixel mapping; i.e. for a particular pixel a particular nozzle is assigned to print same, hypothetically considers a print of a flat field image that might be printed in accordance with the pixel mapping by the nozzle bank under test and the possible nozzle bank considered for pairing with it and further considering the previously determined drop size (dot size) as a function of nozzle. It is desirable that the hypothetically considered flat field image be at least two times longer than the ratio of (total printhead length)/(total number of passes for printing a swath).

In step 240, there is determined the average drop size for each raster row as a result of this hypothetical printing exercise of a flat field image in step 230. As may be seen in FIG. 18 the plot S of the first 300 raster lines is an example of a pairing of two nozzle banks. It will be noted that in FIG. 18, the plot S is repeated starting with raster rows 301 to 600. As an alternative, it may be desirable to discard end effects (such as three nozzles on each end of the plot) as shown in FIG. 17 which can be attributed to scanning and measurement artifacts, however the data discarded is approximated for these end nozzles in step 220 and used in calculations for obtaining the curves of FIG. 18.

In step 250, signal process filtering (low pass filtering) may optionally be provided to more easily identify nozzle banks that are unsuitably matched and to reduce erroneous results due to noise. One example of signal process filtering is to take the moving averages such as and preferably the moving medians using a window of width of say 10 adjacent raster rows, each row having a previously determined average drop size. FIG. 18 illustrates a plot U that is a relatively smoother curve than that of plot S but tracks quite well with plot S. A low pass filter used may be determined based upon the human contrast sensitivity function and expected viewing distance.

In step 260, a check is made for substantial deviations or discontinuities in the smooth version provided by plot U. A threshold is established for determining likelihood for banding. Then, a moving average filter such as a moving median filter of window size of say 10 raster rows is subtracted from a second similar moving average of 10 adjacent raster rows but which is lagging or slightly out of phase. For example, the moving average for raster rows 81–90 may be subtracted from the moving average for raster rows 62–71, which is lagging that of the former. The absolute value of the difference between the moving averages would have the plot shown as T in FIG. 18 and can be compared with a threshold value. Where the threshold value is exceeded likelihood of banding is established. In this example the moving averages are out of phase by an amount equal to the width of the averaging window. Although the example shows the two moving averages are out of phase by an amount equal to length of the averaging window, that need not be the case. As an example, the size of the averaging window (in units of number of raster rows) may be determined such that the quotient of (window size)/DPI<⅛ inches. This is a reasonable approximation that is considered useful for an averaging window (in units of number of raster rows) that is determined by the viewing distance and the human contrast sensitivity function. An alternative way for determining deviations or discontinuities is to examine a power spectrum or Fourier transform of the variation of average dot size as a function of raster rows. In this regard, the power spectrum may be convolved with the human contrast sensitivity function given an expected viewing distance. This function is well known and an example of the function is illustrated in FIG. 13 of U.S. Pat. No. 6,425,652 B2. Although the low-contrast photo-optic human visual system contrast sensitivity function is preferred to be used, other functional forms, such as a Gaussian approximation, can also be used to represent the human visual system sensitivity. Still another alternative for determining deviation or discontinuities is to compute the variation in the average dot size as a function of raster row using a computation that is an approximation to a first derivative.

As an alternative, steps 230,240,250 and 260 may be replaced by determining the variation of the average dot size as a function of raster row by establishing an approximate fit with a polynomial of order 2 or more and this fitted polynomial used to replace the actual data. For example, the fitted polynomial may be a parabolic and categorization thereof based upon the determined coefficients establishing the fit (slope and quadratic coefficients) and a four dimensional table or look-up is used to determine appropriate combinations.

In step 270, where a likelihood of banding is established for this possible pairing, a determination is made that the match is not good and the process steps to step 280. If, however, the indication in step 270 is that a good match is made, the process steps to step 340 where other print modes can be checked as an option. The other print modes comprising different receiver medium advancement schemes and hence different combinations of nozzles forming raster rows. Typically, a printer will have a lookup table that controls the number of raster lines to be advanced after a pass. This number can change depending upon the print mode and even be nonuniform during a print mode, e.g. during some passes in a print mode the number of raster lines stepped may be different than other in other passes within that print mode. Assuming all modes have not as yet been checked, step 350, the process steps to step 360 to provide a new print mode for consideration with this nozzle bank pairing. If all of the possible multiple print modes to be investigated have been checked, then the nozzle bank under test is assembled with the possible pairing nozzle bank to form a printhead.

If, however, in step 270 the match is not considered to be satisfactory, the process steps to step 280 wherein a new nozzle bank is selected from the database and the process repeats with regard to possible pairing of this new nozzle bank with the nozzle bank under test. If, however, all stored possible pairing nozzle banks have now been considered for pairing with the nozzle bank under test and no satisfactory mate can be found for it the process steps to step 300 wherein the characteristics of the nozzle bank under test (drop size as a function of nozzle) determined in step 220 are stored in memory for later consideration for pairing with other new nozzle banks being considered for the test. The process is then repeated for the next nozzle bank to be placed under test.

Figure 20:
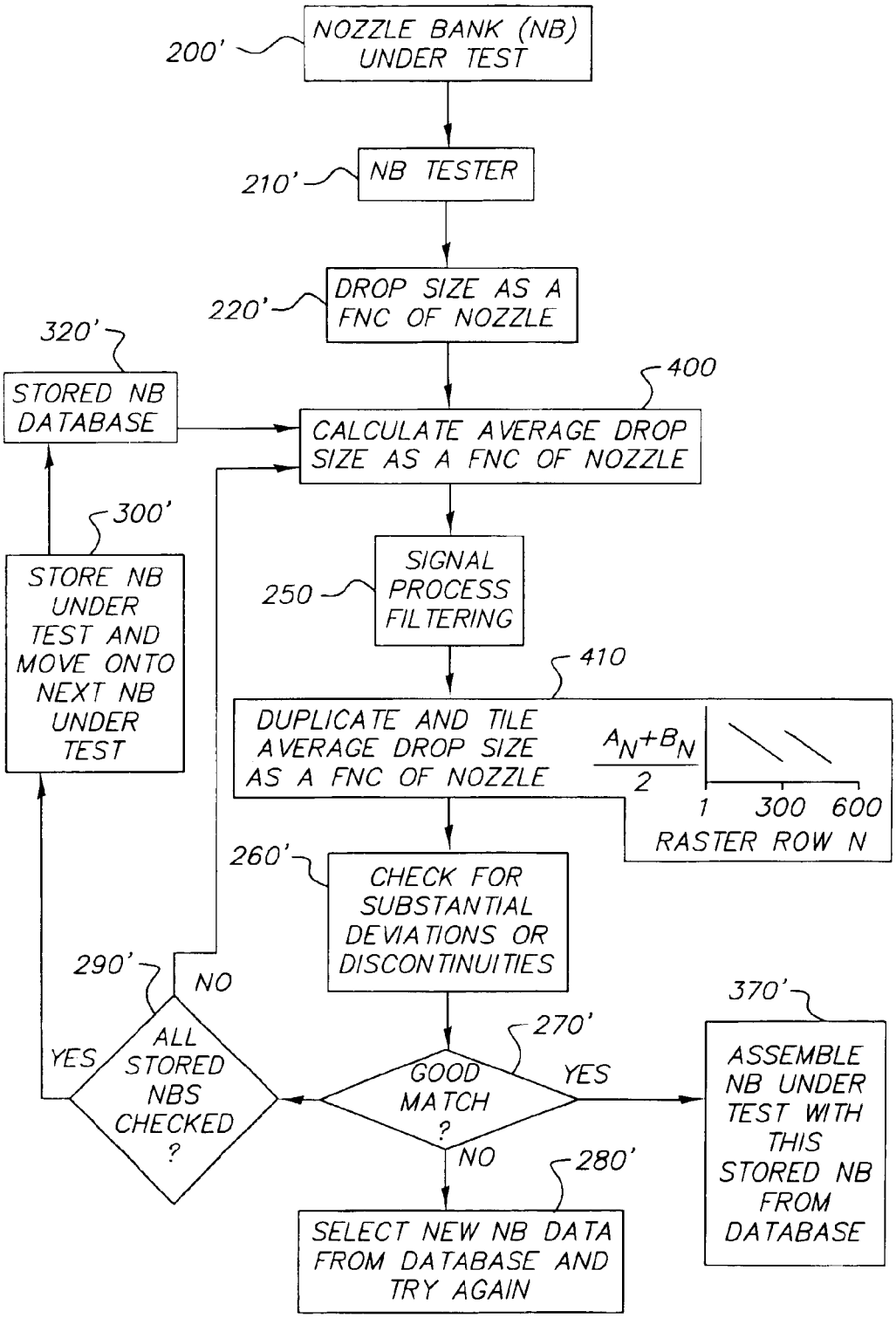
FIG. 20 is a flowchart similar to that of FIG. 19 and illustrating a more simplified method of determining selection of nozzle banks for a printhead in accordance with the invention.

In a simplified version, shown in FIG. 20, of the test process set forth in FIG. 19 an assumption may be that each raster row N is formed by the equal combination of pixels deposited by nozzle 39A(N) and 39B(N), wherein 39A and 39B refer to the arrangement of nozzle banks shown in FIG. 1 and N represents a specific nozzle on each nozzle bank wherein each nozzle bank is considered to have in this example 300 nozzles so that N=1 . . . 300. If a flat field image of raster rows is considered to be hypothetically formed of pixels from nozzle 39A(N) and 39B(N), then the average drop size for each raster row N is merely the sum of the drop sizes from nozzle 39A(N) and 39B(N) divided by two, step 400; thus raster row 1 has an average pixel size of (A1+B1)/2, wherein A1 is the average drop size for nozzle 39A1 and B1 is the average drop size for nozzle 39B1 and so on for each of the N=300 raster rows with (AN+BN)/2 being the average pixel size for raster row N. The plot of average drop size for a raster row versus raster row and resulting from the calculation in step 400 may be optionally low pass filtered in step 250'. This test thus provides significantly reduced amounts of calculations because of the simplified assumption with regard to print mode specification as to determining which nozzles are used to print which raster rows. In FIG. 20, counterpart steps to that of FIG. 19 are indicated by a similar number followed by a prime (′), whereas the different steps 400 and 410 are provided with a new number. After low pass filtering, the N=300 averages for the 300 raster rows calculated in step 400, the results for the N=300 averages may be duplicated as shown in step 410 to consider 600 raster rows. The process set forth in FIG. 19 can then be followed to check for substantial deviations or discontinuities and whether or not there is a good match.

In the above description of the invention of the preferred embodiment, the nozzle banks each comprise nozzles arranged in two rows within each nozzle bank that are permanently coupled together. The invention also contemplates that for at least some nozzle banks the two rows in the nozzle bank may be assembled together to form the nozzle bank and that different combinations of rows can create different combinations of nozzle banks, so that effectively one can employ the above process to select which two rows of nozzles should be selected for assembly together to form a single nozzle bank and then which two nozzle banks should be selected for assembly to form a printhead.

The arrangement of the nozzle banks shown in FIG. 1 illustrates the nozzle banks as being offset in both the slow-scan and the fast-scan direction. In an alternative, the offset in the slow scan direction may be in an amount less than the full length of the nozzle bank so that some of the nozzles from the two nozzle banks overlap in the fast scan direction. It will be further understood that as further alternatives the nozzle banks may be offset in both the slow-scan and fast-scan direction wherein the offset in the slow scan direction is an amount that is more than the length of the nozzle bank or it may be equal to the length of the nozzle bank. As a further alternative, the nozzle banks may be abutted in the slow scan direction. As a still further alternative, the nozzle banks may be arranged as illustrated in FIG. 16 with the nozzle banks spaced in the fast scan direction or alternatively positioned more closely together so as to be abutted in the fast-scan direction.

The invention is applicable both to printheads that are operated in a binary mode (printed dot or no dot decision at each pixel location) as well as in a gray level printing mode (dots of different sizes may be printed at different pixel locations). It is found that even for gray level inkjet printers that matching of nozzle banks using an analysis of the nozzle banks that employs basically a binary consideration of the nozzle bank appears to be valid even though the printhead is operated in a printer for recording gray level pixels. The invention is further applicable to matching of nozzle banks in printer systems wherein different nozzles on different nozzle banks may deposit drops at the same pixel location. For example, the above description has been described in terms of printing of pixels wherein, at least for some of the raster rows, pixels that are printed in a raster row are printed by two or more different nozzles that are located on different nozzle banks. However, some printers operate by building a dot size at a particular pixel location by depositing a drop from a nozzle on one nozzle bank on top of a previously formed dot formed by a drop deposited by a drop from a nozzle on a second nozzle bank forming part of the printhead for printing with the particular color ink. Thus, in such printers not only are there at least some raster rows wherein a raster row of pixels is formed by dots deposited from different nozzles located on different nozzle banks at different pixel locations in the raster row but there is also provided at certain pixel locations in the raster row that are formed by depositing ink from different nozzles from different nozzle banks so that a pixel is formed at a pixel location by building up of ink deposited by at least two different nozzles. Furthermore, a printer may use a combination of these techniques, some raster locations being printed by a single nozzle and other locations being printed by more than one nozzle. All of these configurations are compatible with the techniques described herein.

It will be further understood that for some raster rows only one nozzle may be assigned to print pixels in an entire raster row or that two or more nozzles from the same nozzle bank may be assigned to print a raster row of at least some of the raster rows. In these situations, it has been found that the techniques described herein function properly and as expected provided that the number of raster rows printed entirely by only one of the nozzle banks forms a minority of the total number of raster rows.

As noted above, the invention may be used in conjunction with selection of nozzle banks for use in printing liquids other than ink such as printing onto lithographic plates or for printing of conductive patterns or designs onto circuit boards or other substrates or for printing edible dyes onto cakes or pastries or for building up of three-dimensional structures onto substrates. Furthermore, the invention is also applicable to printers having banks of light emitter recording elements or thermal recording elements that are to be assembled to form a printhead array.

The invention has been described with particular reference to its preferred embodiments, but it will be understood by those skilled in the art that various changes may be made and equivalents may be substituted for elements of the preferred embodiments without departing from the invention. In addition, many modifications may be made to adapt the particular situation and material to a teaching of the present invention without departing from the essential teachings of the invention.

What is claimed is:

1. A method of selecting inkjet nozzle banks for assembly into an inkjet printhead, the printhead when assembled including at least two nozzle banks and operative for printing one particular color ink or other liquid and each nozzle bank including plural nozzles, the printhead being operational in a printer to print raster rows so that at least one raster row is printed using ink drops deposited at respective different pixel locations on the raster row by respective different nozzles on each of the at least two nozzle banks, the method comprising the steps of:

(a) characterizing a drop size parameter for predetermined nozzles of each of the nozzle banks;

(b) identifying for each of plural raster rows the respective different nozzles on each of the at least two nozzle banks that would be used to print the respective raster row;

(c) identifying a size characteristic associated with each of the plural raster rows using a predetermined computer algorithm without printing the raster rows; and (d) determining in accordance with a criterion and data derived from size characteristic identified in step (c) whether or not the at least two nozzle banks are an acceptable match.

2. The method according to claim 1 and wherein in step (b) a simulated flat field image is considered in order to determine which nozzles would be used to print the respective raster row.

3. The method according to claim 2 and wherein in step (c) the size characteristic identified is average dot size for the respective raster row.

4. The method according to claim 3 and wherein in step (d) the data derived from the average dot size for the respective raster row is obtained after a low pass filter operation.

5. A printhead comprising at least two nozzle banks each bank having plural nozzles, the nozzle banks being assembled into the inkjet printhead after determining that they are an acceptable match in accordance with the method of claim 1.

6. The method according to claim 1 wherein there is calculated variation in average dot size as a function of raster row by computing a subtraction of two moving averages, each of the moving averages being slightly out of phase with respect to each other.

7. The method according to claim 6 wherein the two moving averages are out of phase by an amount equal to the length of the averaging window.

8. The method according to claim 6 wherein the size of the averaging window in units of number of raster rows is determined such that the quotient of (window size)/DPI<⅛".

9. The method according to claim 1 wherein in the step of characterizing a drop size parameter an investigation is made of the dot size of a printed dot.

10. The method according to claim 1 wherein in the step of characterizing a drop size parameter an investigation is made of a width or widths of printed line(s), the printed line(s) being printed by a single nozzle.

11. The method according to claim 1 and wherein in step (c) a variation of average dot size as a function of raster row is determined and is processed through a low-pass filter.

12. The method according to claim 11 and wherein bandpass of the low pass filter is determined based upon at least expected viewing distance.

13. The method according to claim 12 and wherein bandpass of the low pass filter is also determined based upon human contrast sensitivity function.

14. The method according to claim 1 and wherein a variation of average dot size as a function of raster row is determined and then defined by a linear or polynomial approximation.

15. The method according to claim 1 and wherein multiple different print modes are used in order to determine whether or not the at least two nozzle banks are an acceptable match.

16. The method according to claim 1 and wherein a variation of average dot size as a function of raster row is computed by an approximation to a first derivative.

17. The method according to claim 1 and wherein in step (c) raster rows are considered to be printed using the at least two nozzle banks that are abutted in a fast-scan direction.

18. The method according to claim 1 and wherein in step (c) raster rows are considered to be printed using the at least two nozzle banks that are abutted in a slow-scan direction.

19. The method according to claim 1 and wherein in step (c) raster rows are considered to be printed using the at least two nozzle banks that are offset in both a slow-scan and fast-scan direction.

20. The method according to claim 19 and wherein the at least two nozzle banks are offset in the slow-scan direction in an amount less than the length of one of the nozzle banks.

* * * * *